US005918935A

United States Patent [19]

Stulik et al.

[11] Patent Number: 5,918,935

[45] Date of Patent: Jul. 6, 1999

[54] RECLINING CHAIR

[76] Inventors: Edward L. Stulik, 7500 Hill Rd., Granite Bay, Calif. 95746; Bruce Burness, 1260 Yocum St., Pasadena, Calif. 91103

[21] Appl. No.: 08/868,448

[22] Filed: Jun. 3, 1997

[51] Int. Cl.[6] ..... A47C 1/024; A47C 3/22

[52] U.S. Cl. ..... 297/300.5; 297/301.4; 297/302.4; 297/303.4; 267/177; 248/597

[58] Field of Search ..... 297/300.5, 300.2, 297/301.4, 302.4, 303.4; 267/131, 132, 177; 248/550, 597

[56] References Cited

U.S. PATENT DOCUMENTS

| | | | |
|---|---|---|---|
| 910,357 | 1/1909 | Case . | |
| 2,272,980 | 2/1942 | McLellan et al. . | |
| 2,479,175 | 8/1949 | McArthur . | |
| 2,611,420 | 9/1952 | Diehl . | |
| 2,616,483 | 11/1952 | Jensen . | |
| 2,925,122 | 2/1960 | Winick . | |
| 3,856,346 | 12/1974 | Herman . | |
| 4,372,608 | 2/1983 | Hotta . | |
| 4,386,805 | 6/1983 | Boisset . | |
| 4,402,546 | 9/1983 | Johnson . | |
| 4,529,247 | 7/1985 | Stumpf et al. . | |
| 4,650,248 | 3/1987 | Borsani . | |
| 4,682,814 | 7/1987 | Hansen . | |
| 4,684,173 | 8/1987 | Locher . | |
| 4,709,962 | 12/1987 | Steinmann | 297/300.5 |
| 4,779,925 | 10/1988 | Heinzel . | |
| 4,804,227 | 2/1989 | Hansen . | |
| 4,865,384 | 9/1989 | Desanta . | |
| 4,889,384 | 12/1989 | Sulzer . | |
| 4,889,385 | 12/1989 | Chadwick et al. . | |
| 4,892,354 | 1/1990 | Estkowski et al. . | |
| 4,911,501 | 3/1990 | Decker et al. . | |
| 4,962,962 | 10/1990 | Machata et al. . | |
| 5,033,791 | 7/1991 | Locher . | |
| 5,046,780 | 9/1991 | Decker et al. . | |
| 5,160,184 | 11/1992 | Faiks et al. . | |
| 5,288,138 | 2/1994 | Stulik et al. . | |
| 5,366,274 | 11/1994 | Roericht et al. | 297/300.2 |
| 5,375,912 | 12/1994 | Stulik et al. . | |
| 5,582,459 | 12/1996 | Hama et al. | 297/300.2 |
| 5,660,439 | 8/1997 | Unwalla | 297/300.2 |

FOREIGN PATENT DOCUMENTS

| | | |
|---|---|---|
| 4220881-A1 | 1/1993 | Germany . |

*Primary Examiner*—Peter M. Cuomo
*Assistant Examiner*—Anthony D. Barfield
*Attorney, Agent, or Firm*—Koda & Androlia

[57] ABSTRACT

A reclining chair including a support base, a chair seat rotatably coupled at its forward portion to the support base, a substantially vertically disposed coil spring provided adjacent the forward portion of the seat and between the seat and the support base such that the coil spring is pivotally coupled to the seat portion and the support base at its ends and an apparatus for pivoting one end of the coil spring about another end of the coil spring.

6 Claims, 14 Drawing Sheets

RECLINING CHAIR

BACKGROUND OF THE INVENTION

1. Field of the Invention

This invention relates to reclining chairs and more particularly, to mechanisms for reclining the seat and back portion of such reclining chairs.

2. Prior Art

In the prior art, there are several different types of reclining chairs. All of these reclining chairs essentially perform the same function. That is the function of reclining; however, these prior art reclining chairs all have certain deficiencies. In particular, when the chairs recline, the feet of the person sitting in the chair rise off the floor as the front portion of the seat rises. Such a condition is particularly undesirable in reclining chairs utilized in offices.

The reclining mechanism is usually further provided with a spring which can be adjusted for preload for varying the biasing force against the reclining motion of the chair so that the chair cannot fall backward with the person in it; however, this spring can be adjusted only for preload and nothing else. Preload adjustability alone does not provide the capability for equal starting positions for large and small persons and does not provide the same feel throughout the range of reclining travel for large and small persons. As a result, chairs with only preload adjustability are optimized essentially for only one size person. Therefore, chairs which are designed for people who are heavy cannot be utilized by people who are light in weight and vice versa.

There does exist reclining chairs in the prior art which reduce or eliminate the first above disadvantage; however, while these prior art reclining chairs may reduce or eliminate this disadvantage, they have other disadvantages of their own. Examples of such disadvantages are that they are complex in structure, difficult and expensive to manufacture and do not feel equally comfortable during reclining motion for both light and heavy weight persons.

Examples of prior art reclining chairs which possess one or more of the above disadvantages and which may have attempted to solve some of the above-described disadvantages are described in the issued patents as follows:

| United States: | | |
|---|---|---|
| 910,357 | 2,272,980 | 2,479,175 |
| 2,611,420 | 2,616,483 | 2,925,122 |
| 3,856,346 | 4,372,608 | 4,386,805 |
| 4,402,546 | 4,529,247 | 4,650,248 |
| 4,682,814 | 4,684,173 | 4,779,925 |
| 4,804,277 | 4,865,384 | 4,889,384 |
| 4,889,385 | 4,892,354 | 4,911,501 |
| 4,962,962 | 5,033,791 | 5,046,780 |
| 5,160,184 | 5,288,138 | 5,375,912 |
| German | | |
| DE4220881-A1 | | |

SUMMARY OF THE INVENTION

Accordingly, it is a general object of the present invention to solve the disadvantages described above in the prior art.

In particular, it is a specific object of the present invention to provide a reclining chair which does not raise the feet of a person who is seated in the chair as it reclines, does not cause discomfort to the person seated in the chair as it reclines and is capable of being utilized equally comfortably by both heavy and lightweight persons.

It is yet another object of the present invention to provide a reclining chair with simultaneous adjustment of both the preload and the spring rate.

It is another object of the present invention to provide a reclining chair which will provide equal performance for a wide size range of persons.

It is still another object of the present invention to provide a reclining chair which includes a mechanism which is relatively simple in structure, easy to manufacture and low in cost to make.

In keeping with the principles and objects of the present invention, the objects are accomplished by a unique reclining chair including a support base, a chair comprising at least a seat portion, a means for coupling a forward portion of the seat portion to the support base such that the seat portion moves substantially about a pivoting axis located adjacent to the forward portion, a substantially vertically disposed coil spring means provided adjacent to the forward portion of the seat portion and between the seat portion and the support base, a means for coupling ends of the coil spring means pivotally to the seat portion and the support base and a means for pivoting one end of the coil spring means about an other end of the coil spring means whereby a force per unit distance of reclining of the seat portion as the chair is reclined may be varied and a reclining chair which is comfortable to sit in by both heavy and lightweight persons is provided.

BRIEF DESCRIPTION OF THE DRAWINGS

The abovementioned features and objects of the present invention will become more apparent with reference to the following description taken in conjunction with the accompanying drawings wherein like reference numerals denote like elements and in which.

DETAILED DESCRIPTION OF THE INVENTION

Figure 1:
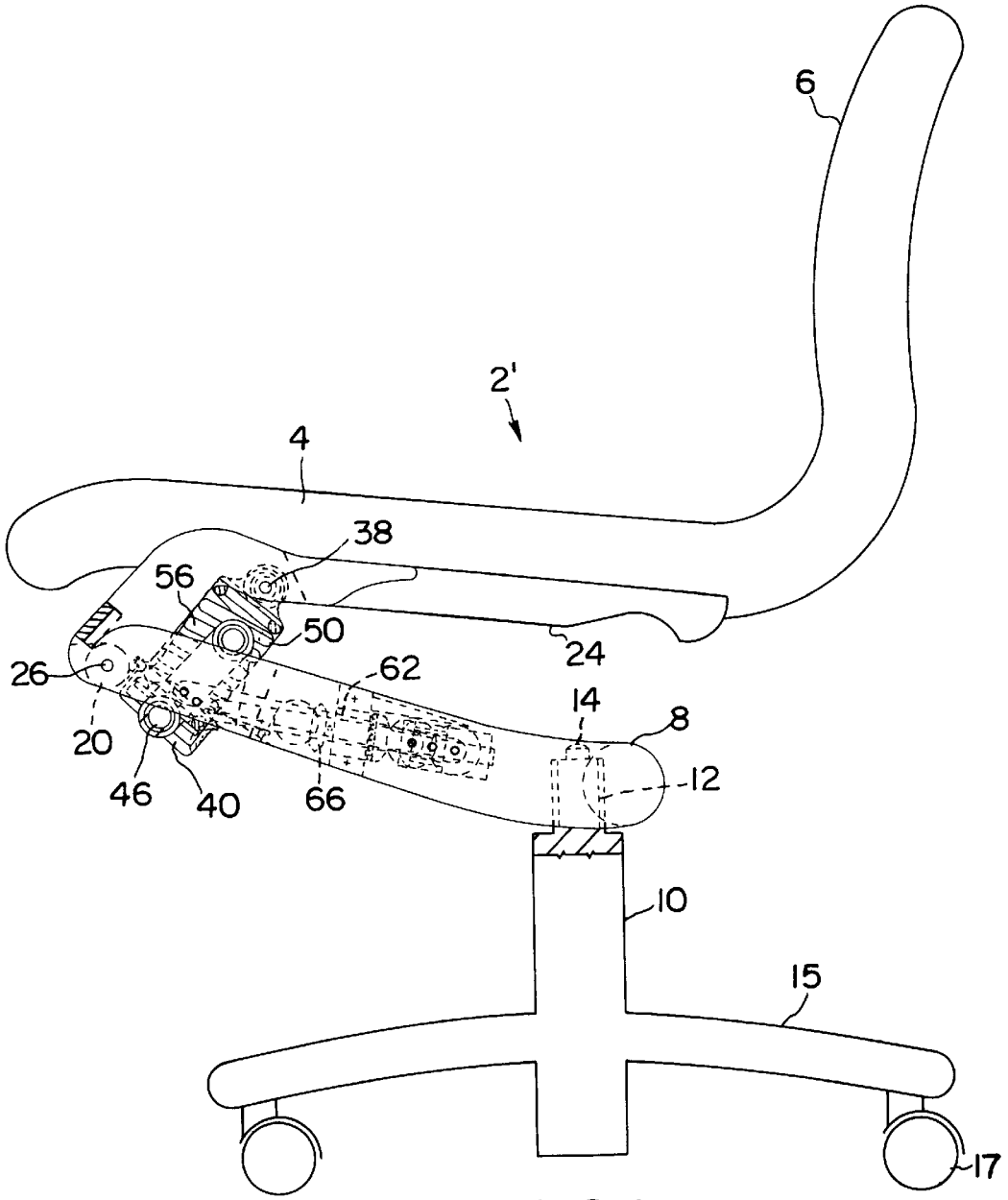
FIG. 1 is a partially cut-away side view of a reclining chair in accordance with the teachings of the present invention.

Referring to FIGS. 1–4, shown therein is a first embodiment of the present invention. In particular, the reclining chair 2 comprises a seat portion 4 and a back portion 6 which are formed integrally. The reclining chair 2 further includes a base 8 which is rotatably coupled to a pedestal 10 by means of a tapered cup 12 which rotatably engages with a tapered pin 14. The pedestal 10 is further provided with legs 15 on which are provided rollers 17. Extending forwardly from the base 8 are two support arms 16 and 18. The forwardly projecting support arms 16 and 18 are further provided at their ends with cylindrical holes 20 into which bearings 22 are inserted.

To the bottom of the seat portion 4 is provided a mounting plate 24. The mounting plate 24 is pivotally coupled to the forward portions of the support arms 16 and 18 by means of a shaft 26 which extends through the bearing 22 and holes in the forward portion of the mounting plate 24. The shaft 26 is provided in parallel to an axis passing through a person sitting in the reclining chair. To the underside of the mounting plate 24 adjacent the forward portion of the mounting plate 24 is provided downwardly projecting tabs 28 and 30. To these downwardly extending tabs 28 and 30 is rotatably coupled an upper spring cup 32 by means of bearings 34, holes 36 and shaft 38. A lower spring cup 40 is mounted to two upwardly projecting arms 42 and 44. This mounting is a rotatable mounting and is effected by means of cylindrical portions 46 which fit into bearings 48 in the arms 42 and 44. The other end of the arms 42 and 44 are respectively connected to the support arm 16 and 18 by means of screws 50 and bearings 52 which fit into holes 54 provided in the ends of the arms 16 and 18. A coil spring 56 is provided between the upper and lower spring cups 32 and 40.

A fixed block 60 is provided between the support arms 16 and 18. The fixed block 60 is provided with a hole 62. Through the hole 62 is a drive shaft 64. One end of the drive shaft 64 is provided with a bevel gear 66. The bevel gear 66 engages with another bevel gear 68 provided at right angles to the bevel gear 66. The bevel gear 68 is provided on a shaft 70 which is supported by arms 72 and 74, and a knob 76 is provided on the end of the shaft 70. The gear ratio between bevel gears 66 and 68 can be set depending on the weight range of the reclining chair 2. The other end of the drive shaft 64 is threaded and is threaded into a movable block 80. Coupled to the ends of the movable block 80 are forwardly extending arms 82 and 84 and rollers 86. The rollers 86 are provided on shafts 88 extending from the ends of the movable block 80. The rollers 86 roll on guides 90. A guide surface 90*a* of the guides 90 is provided in parallel to the threaded portion of the drive shaft 64.

The other ends of the arms 82 and 84 are rotatably coupled to the arms 44 and 42 by means of pins and holes. The coupling point between the arms 82 and 84 and the arms 44 and 42 is located above shaft 46 but below screws 50. In addition, it should be apparent from the figures that the screw 50 is provided at a point above where the arms 44 and 42 are coupled to the arms 82 and 84, but below the position where the upper cup 32 is pivotally mounted to the mounting plate 24. As a result of the arrangement of the three pivoting axises identified by the numerals 38, 50 and 46, the coil spring 56 may be pivoted in its orientation and particularly pivoted to a position which is at some angle to a perpendicular to the mounting plate 24. As the spring cup 40 moves away from the shaft 26, the effective rate of the spring increases. Similarly, as the spring moves closer to the shaft 26, the effective rate of the coil spring 56 will decrease. In particular and referring to FIG. 2, when the spring is oriented in the C position, the effective spring rate and force exerted against the mounting plate 24 will be the highest, and when the spring is moved into the position A, the force or effective spring rate will be the least.

Figure 2:
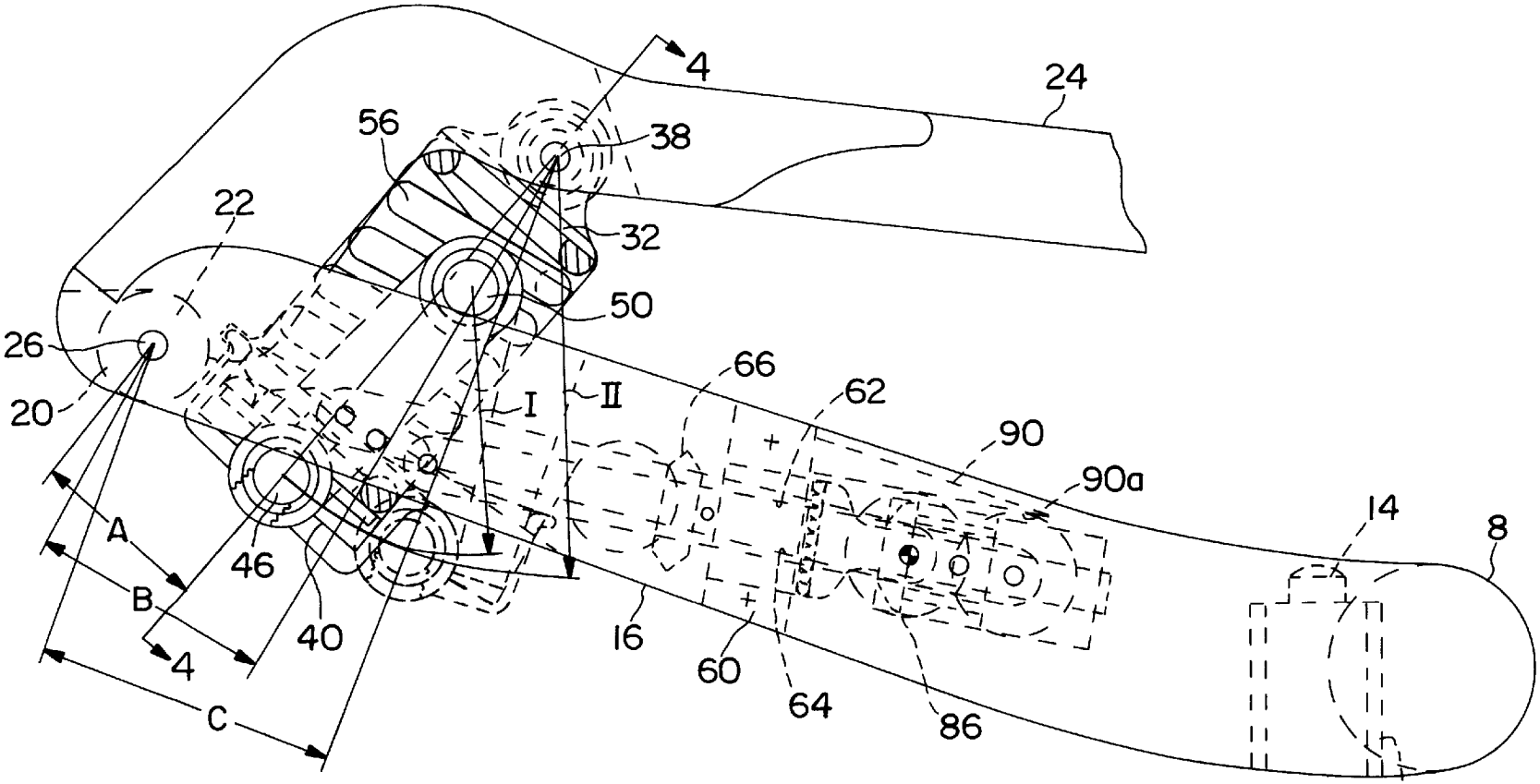
FIG. 2 is an enlarged cross-sectional view of the mechanism of FIG. 1.
Figure 3:
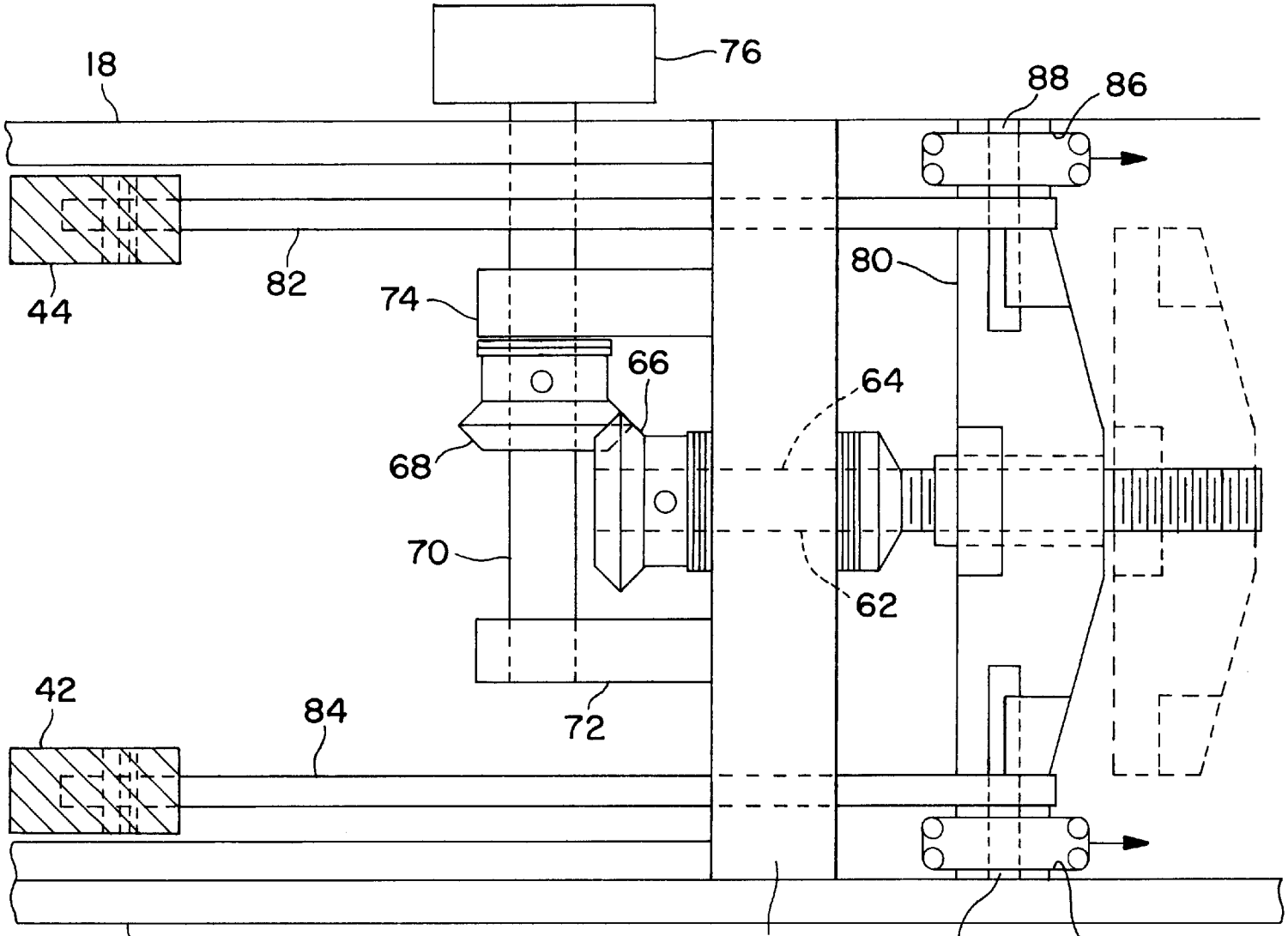
FIG. 3 is a top view of a portion of the mechanism of FIG. 1 with the chair portion removed.
Figure 4:
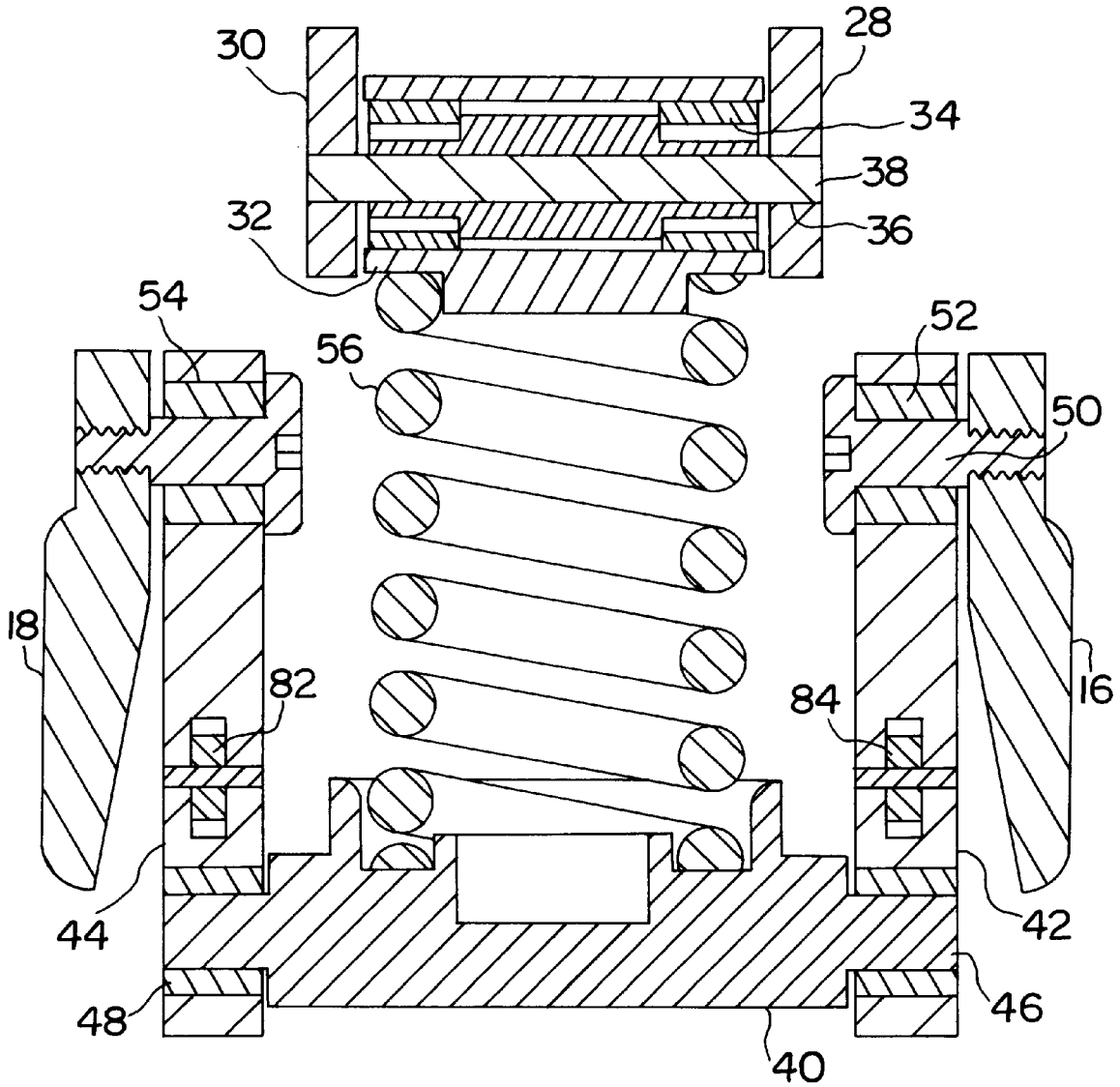
FIG. 4 is a cross-section of FIG. 2 along the lines 4—4.
Figure 6A:
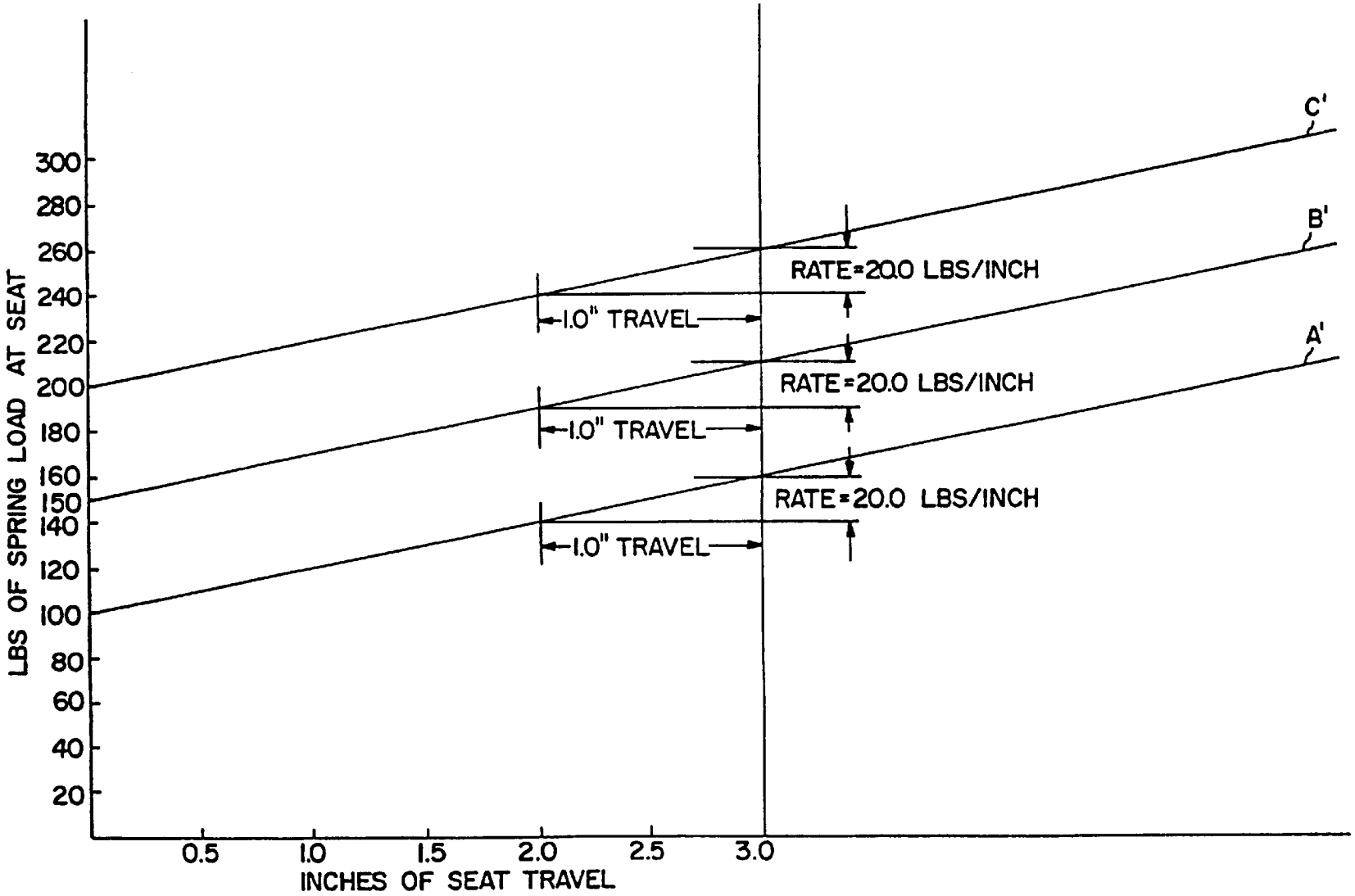
FIGS. 6A, 6B and 6C illustrate respectively load vs. seat travel for a conventional mechanism, load vs. seat travel for the present invention and load curve comparisons for the conventional mechanism and the present invention.
Figure 6B:
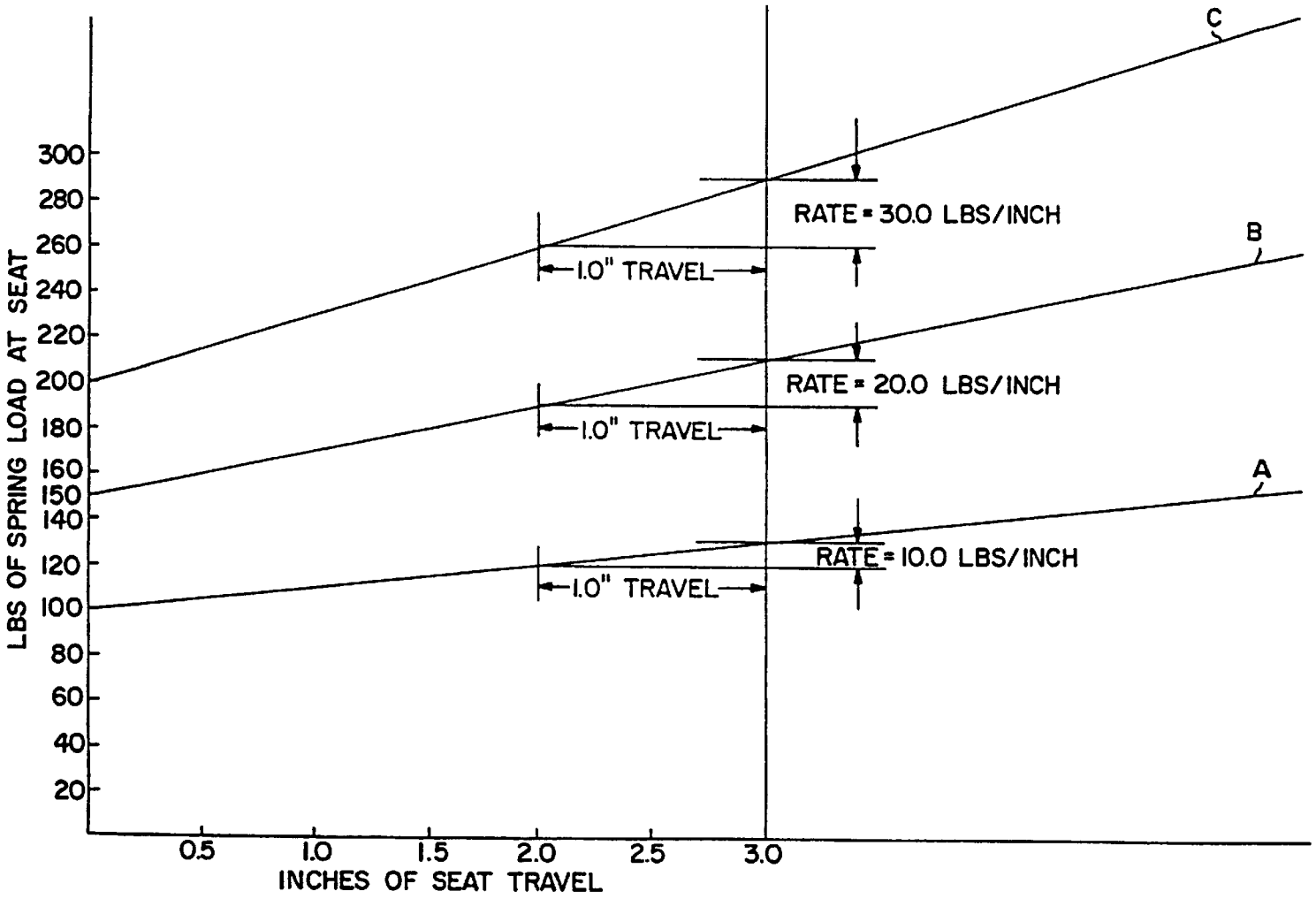
Figure 7A:
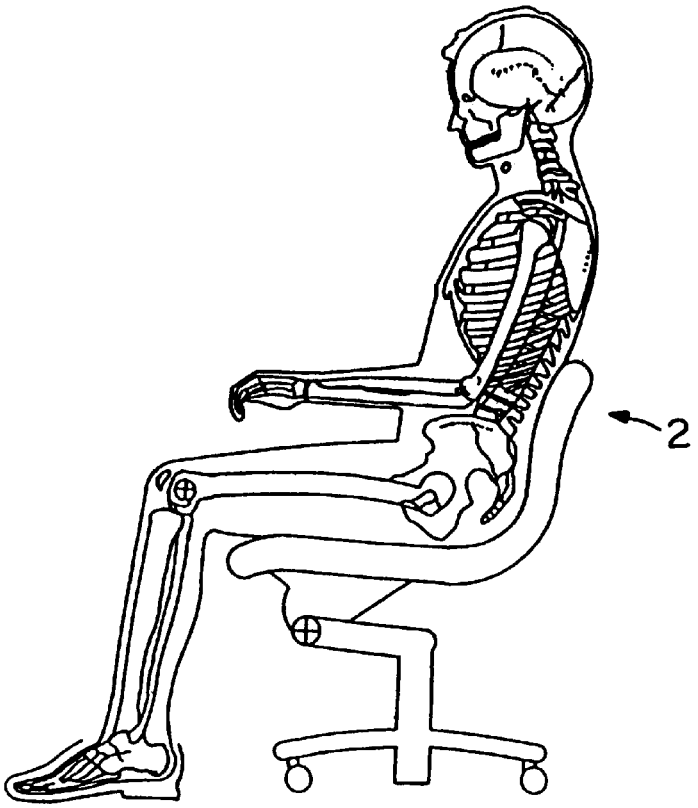
FIGS. 7A and 7B are simplified views illustrating the reclining motion of the present invention.
Figure 7B:
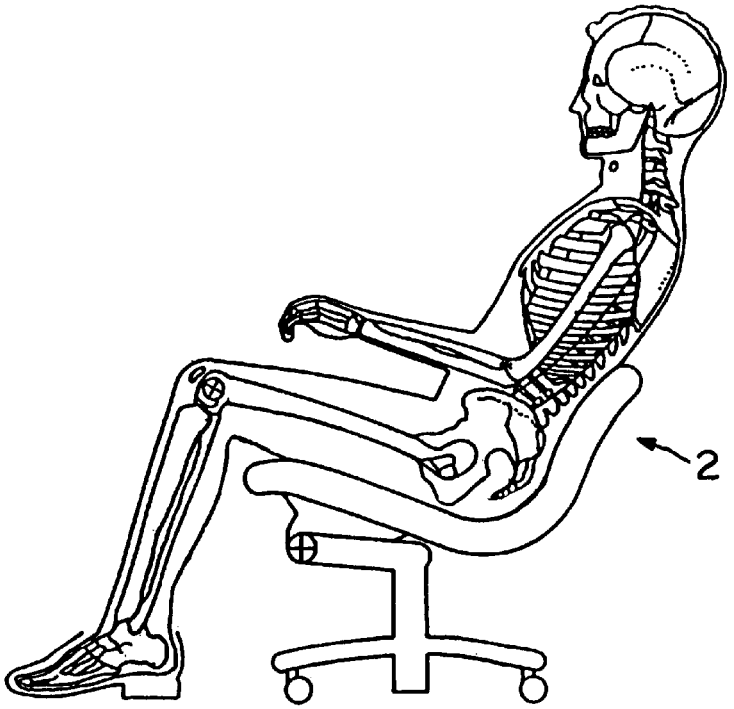

In operation, an individual sits in a reclining chair as is illustrated in the FIG. 7A. Since the pivot point formed by the shaft 26 is provided parallel to an axis passing through a knee joint of a person sitting in the chair 2, the chair 2 reclines about an axis provided in parallel to an axis extending through the knee joint of a person seated in the reclining chair 2 and reclines without raising the person's feet from the floor or causing the person discomfort, as is shown in FIGS. 7B. Still further and as shown in FIG. 2, since the distance from the shaft 26 of the coil spring 56 changes by rotating knob 76 and thereby moving movable block 80, the effective spring rate of the coil spring 56 can be changed. As a result, the effective spring rate of the coil spring 56 which generates an opposing force as the chair 2 is reclined can be varied. This variation is shown in FIG. 6B. As is shown in FIG. 6B, as the bottom end of the spring 56 moves from B to C in FIG. 2, the effective spring constant, or in other words the force per unit travel of the spring as it is compressed, increases non-linearly. Alternately, as the bottom end of the spring 56 is moved to position A in FIG. 2, the effective spring constant is a minimum. As a result and as is shown in FIG. 7B, the effective spring rate increases from the soft setting at the distance A of approximately 10 lbs. per inch of travel to 20 lbs. per inch of travel for the medium setting at the distance B, and then to the rate of 30 lbs. per inch for the hard setting shown by C in FIG. 6B. In comparison thereto, in FIG. 6A is shown the conventional soft, medium and hard settings A', B' and C', respectively. In all cases, the rate is a constant 20 lbs. per inch of travel. Accordingly, it should be apparent that the conventional system is essentially optimized to be utilized only for the medium setting.

Figure 6C:
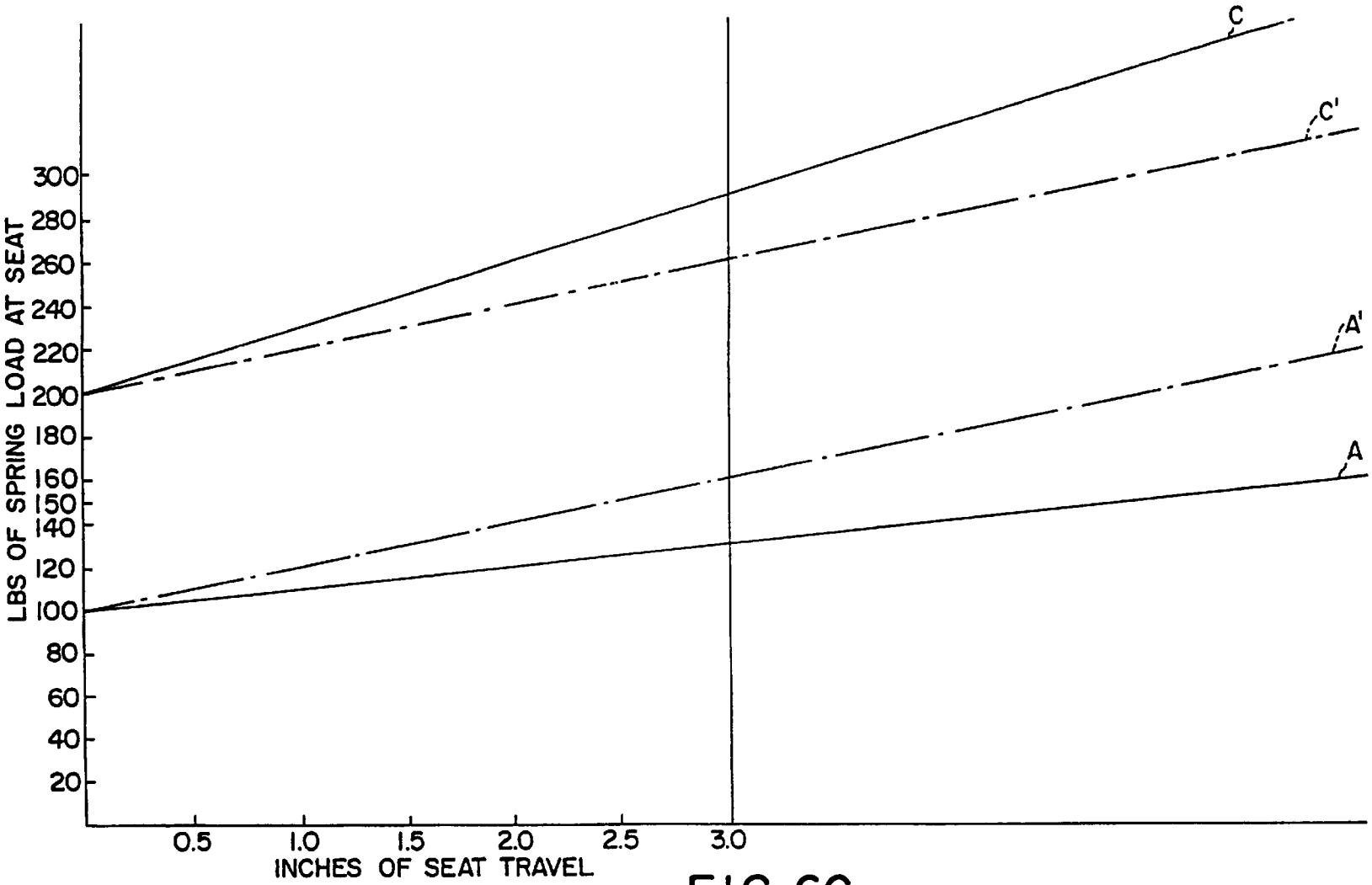

Still further and as is apparent from FIG. 2, the center of rotation of the coil spring 56 about shaft 38 is different or displaced from the center of rotation of the arms 42 and 44 about screw 50. This difference or displacement results in two different radiuses of movement I and II. The difference in these radiuses I and II increases as the coil spring 56 is rotated towards the vertical orientation and results in producing a variation in the preload on the reclining chair 2 which is simultaneous with the changes in the effective spring rate. The importance of this simultaneous variation in the preload with the change in the effective spring rate is apparent from the FIG. 6C. Looking first at the line A which represents the effective biasing force of the spring per inch of travel of the seat of a reclining chair incorporating the present invention and comparing it with the dashed line A' which illustrates the biasing force of a spring of a conventional reclining chair. As is apparent from comparing the lines A and A', as the seat of the reclining chair is reclined, the biasing force for the soft setting becomes too hard with the conventional design. Alternately, looking at the line C which represents the hard setting for the distance or position C in FIG. 2, the present invention and the dash line C' which represents the hard setting for a conventional chair, it should be apparent that as the conventional chair is reclined, the biasing force becomes too soft. As a result in either case, the individual sitting in the chair becomes uncomfortable the more the chair is reclined with the conventional chair. Therefore, with the construction of the present invention, by rotating the knob 76 to simultaneously vary the preload and effective spring rate, the reclining chair 2 can be made to recline comfortable for persons over a range of approximately 90 lbs. to 290 lbs, or in other words of a weight ratio of 3:1.

Figure 5:
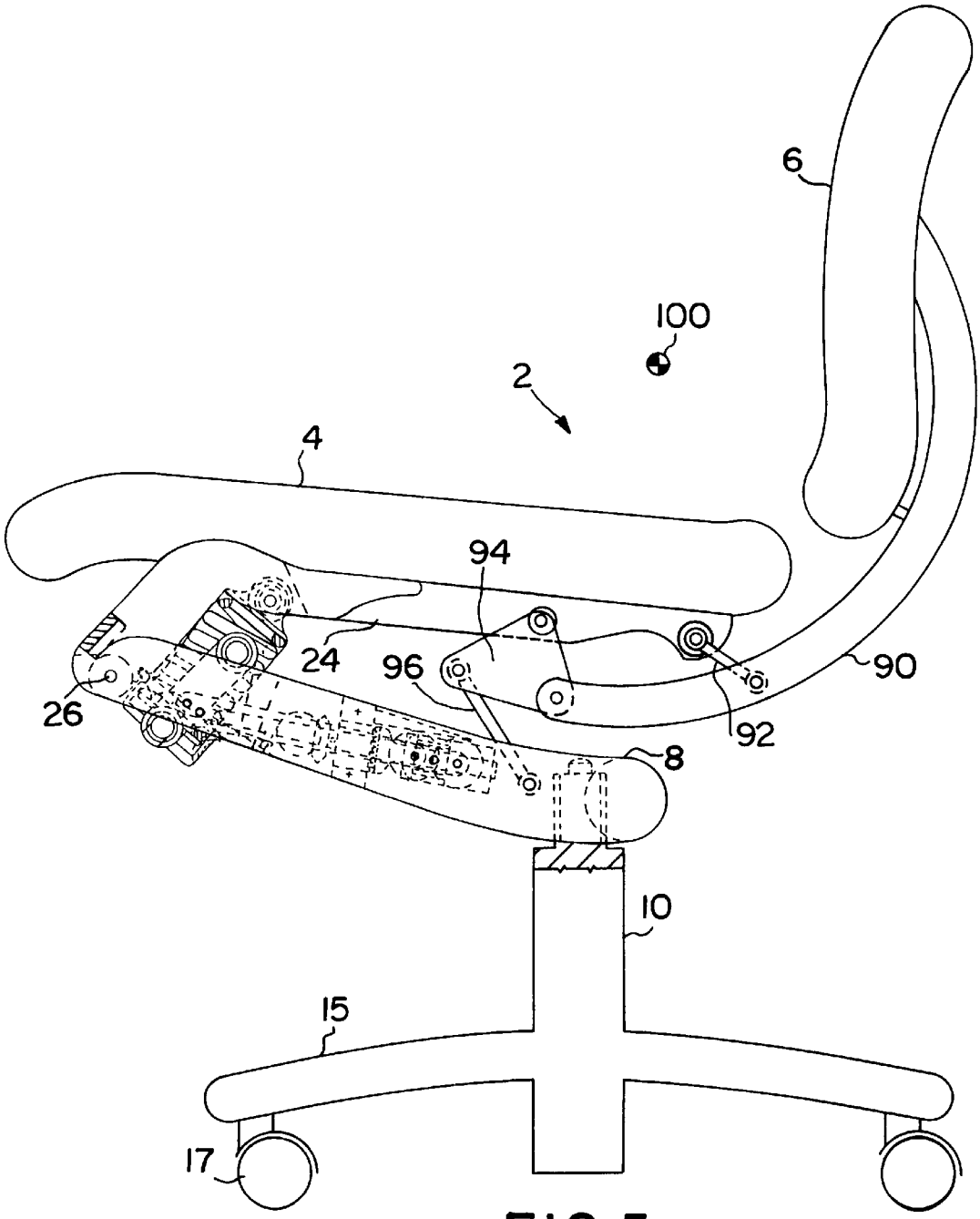
FIG. 5 is a partially cut-away side view of a second embodiment of a reclining chair in accordance with the teachings of the present invention.
Figure 9:
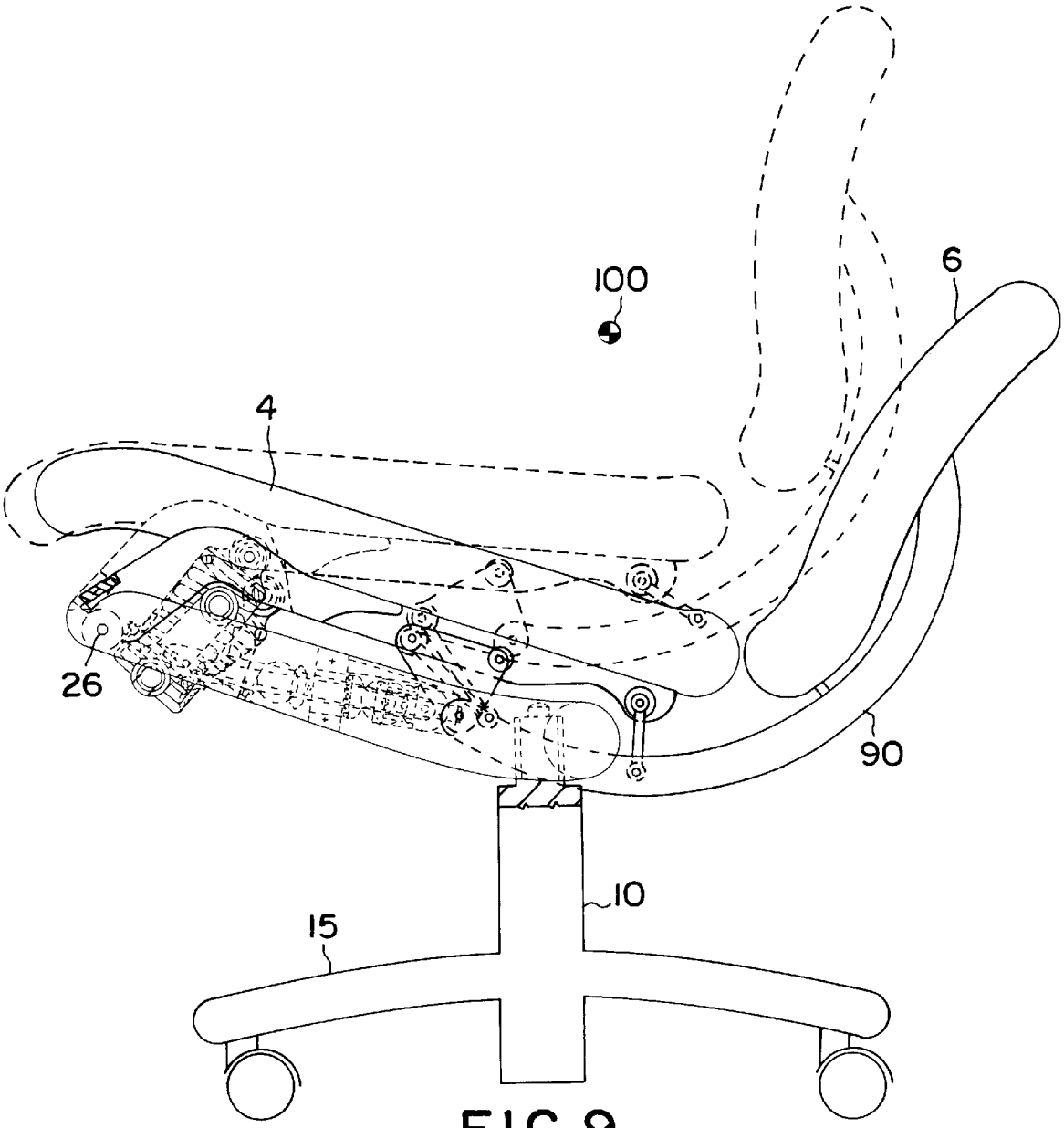
FIG. 9 is a partially cut-away side view of the second embodiment of FIG. 5 illustrating the reclined and unreclined position of the components of the present invention.

Looking next at FIGS. 5 and 9, shown therein is a second embodiment of a reclining chair 2' in accordance with the teachings of the present invention. However, in this reclining chair 2' the seat portion 4 and the back portion 6 are provided independently. The remainder of the elements of the chair 2' operate and are connected together in exactly the same way as in the first embodiment of FIGS. 1–4.

Looking particularly at FIGS. 5 and 9, the reclining chair 2' further includes an intermediate curved link 90. The curved link 90 is pivotally coupled to the support plate 24 by means of an upper link 92 and a triangular plate 94. Particularly, one corner of the triangular plate 94 is coupled to the mounting plate 24, one corner of the triangle is coupled to the curved link 90 and the third corner of the triangle is coupled to the base 8 by means of a link 96. The intermediate curved link 90 is also fixedly connected to the seat back 6 at at least one point.

Figure 8A:
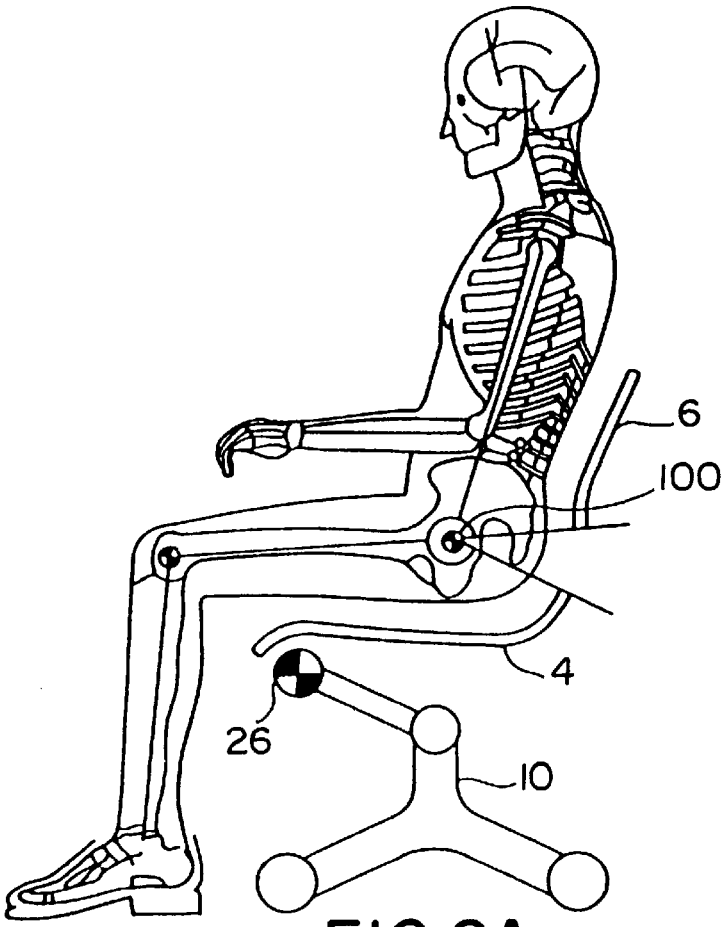
FIGS. 8A and 8B are simplified views illustrating the reclining motion of the second embodiment of the present invention shown in FIG. 5.
Figure 8B:
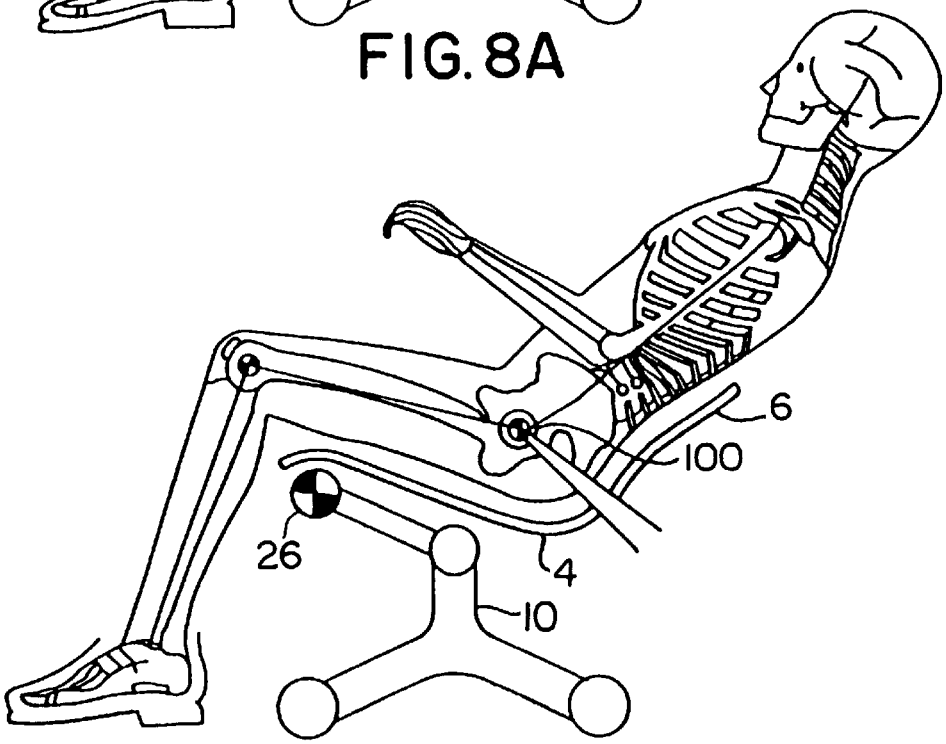

The mechanism comprising the curved link 90, the links 92 and 96 and the triangular plate 94 cause the seat back 6 to recline or pivot about a point 100 in the proximity of the hip of a person seated in the reclining chair 2 as the seat 4 is downwardly pivoted about the shaft 26. Accordingly, the shapes and lengths of the links 90, 92 and 96 and the triangular plate 94 are selected such that the intermediate curved link 90 rotates about a constant radius centered about the point 100 in the proximity of the hip of a person seated in the chair. Therefore, as the seat portion 4 of the reclining seat 2' is reclined, the seat back the proximity of the hi point 100 in the proximity of the hip of a person sitting in the seat as shown in FIGS. 8A and 8B and further contribute to the comfort of a person sitting in the reclining chair 2' by reducing the shear motion.

Figure 10:
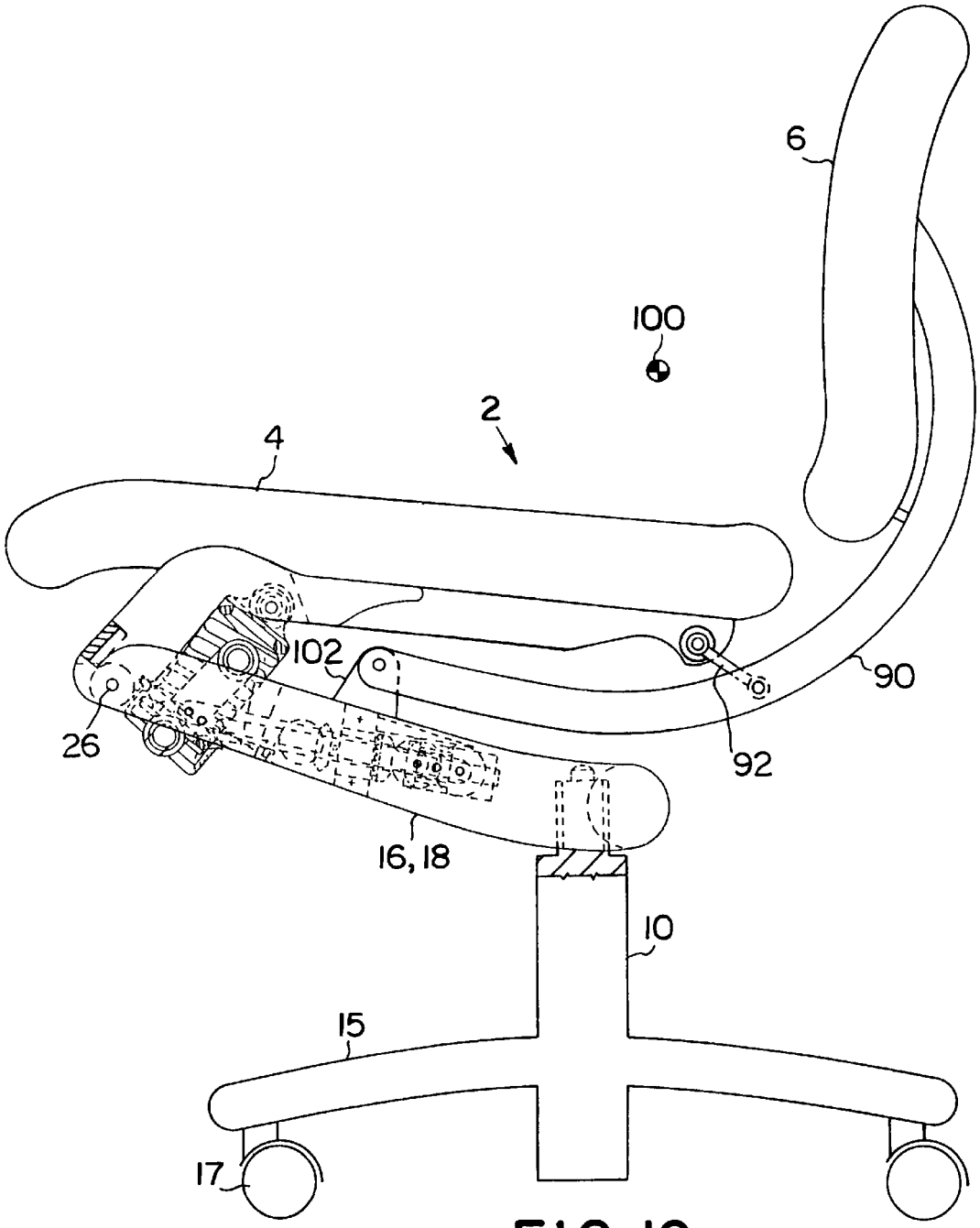
FIGS. 10, 11 and 12 are partially cut-away side views of third, fourth and fifth embodiments similar to the second embodiment of FIG. 5.

Referring to FIG. 10, shown therein is a third embodiment similar to that of FIG. 5. In this third embodiment, like elements are denoted by like reference numerals and function substantially the same as they do in FIG. 5. However, the structure of FIG. 10, while performing the same function as FIG. 5, is constructed differently. In particular, instead of coupling the bottom end of the curved link 90 to the seat 4 by means of a triangular plate, the lower end of the curved link 90 is pivotally coupled to the support arms 16 and 18. As in second embodiment of FIG. 5, as the seat 4 is reclined, the seat back 2 reclines or pivots about a point 100 in the proximity of the hip of a person seated in the reclining chair 2 as the seat 4 is downwardly pivoted about the shaft 26. Accordingly, the shapes and lengths of the links 90 and 92 and the placement of the support 102 are selected such that the intermediate curved link 90 rotates about a radius centered about a point 100 in the proximity of the hip of a person seated in the chair. Accordingly, the third embodiment of FIG. 10 executes substantially the same movement as the second embodiment of FIG. 5 as the seat 4 is reclined.

Figure 11:
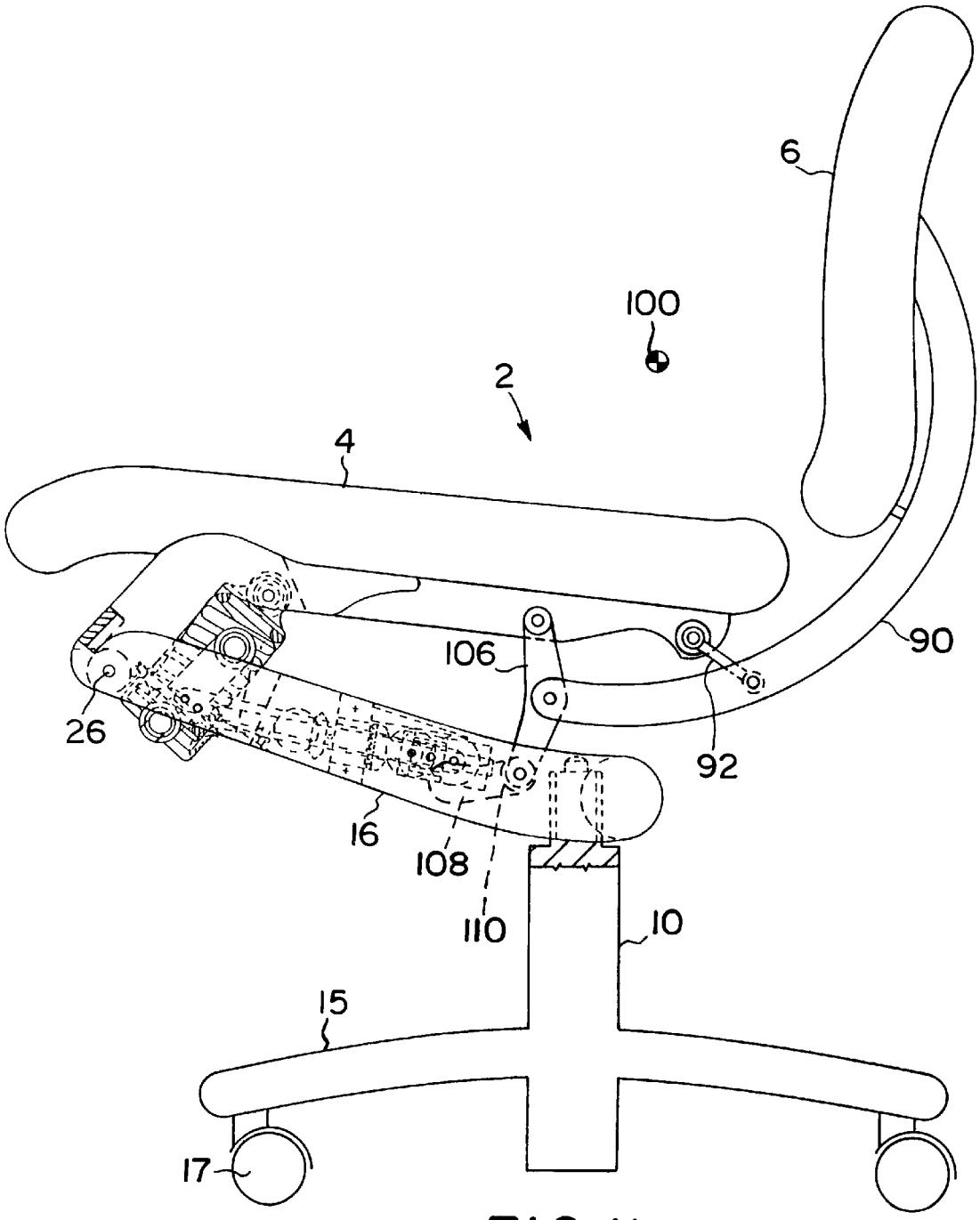

Referring the FIG. 11, shown therein is a fourth embodiment of the present invention. Again, this fourth embodiment of the present invention performs substantially the same function as the second embodiment of FIG. 5 and like elements are given like reference numerals and function substantially the same. In addition, in the fourth embodiment of FIG. 11, the lower end of the curved link 90 is connected to a boomerang-shaped plate 106. The upper end of the boomerang-shaped plate 106 is pivotally coupled to the seat 4 and the lower end of the boomerang-shaped plate 106 is provided in a guide groove 108 provided in support arm 116 by means of a roller 110. Similar to the mechanisms of the second and third embodiments, the mechanism of the fourth embodiment comprising the curved link 90, the link 92, the boomerangshaped plate 106 and the guide groove 108 cause the seat back 6 to recline or pivot about a point 100 in the proximity of the hip of a person seated in the reclining chair 2 as the seat 4 is downwardly pivoted about the shaft 26. Accordingly, the shapes and lengths of the links 90 and 92 and the boomerang-shaped plate 106 and guide groove 108 are selected such that the curved link 90 rotates about a radius centered about the point 100 in the proximity of the hip of a person seated in the chair.

Figure 12:
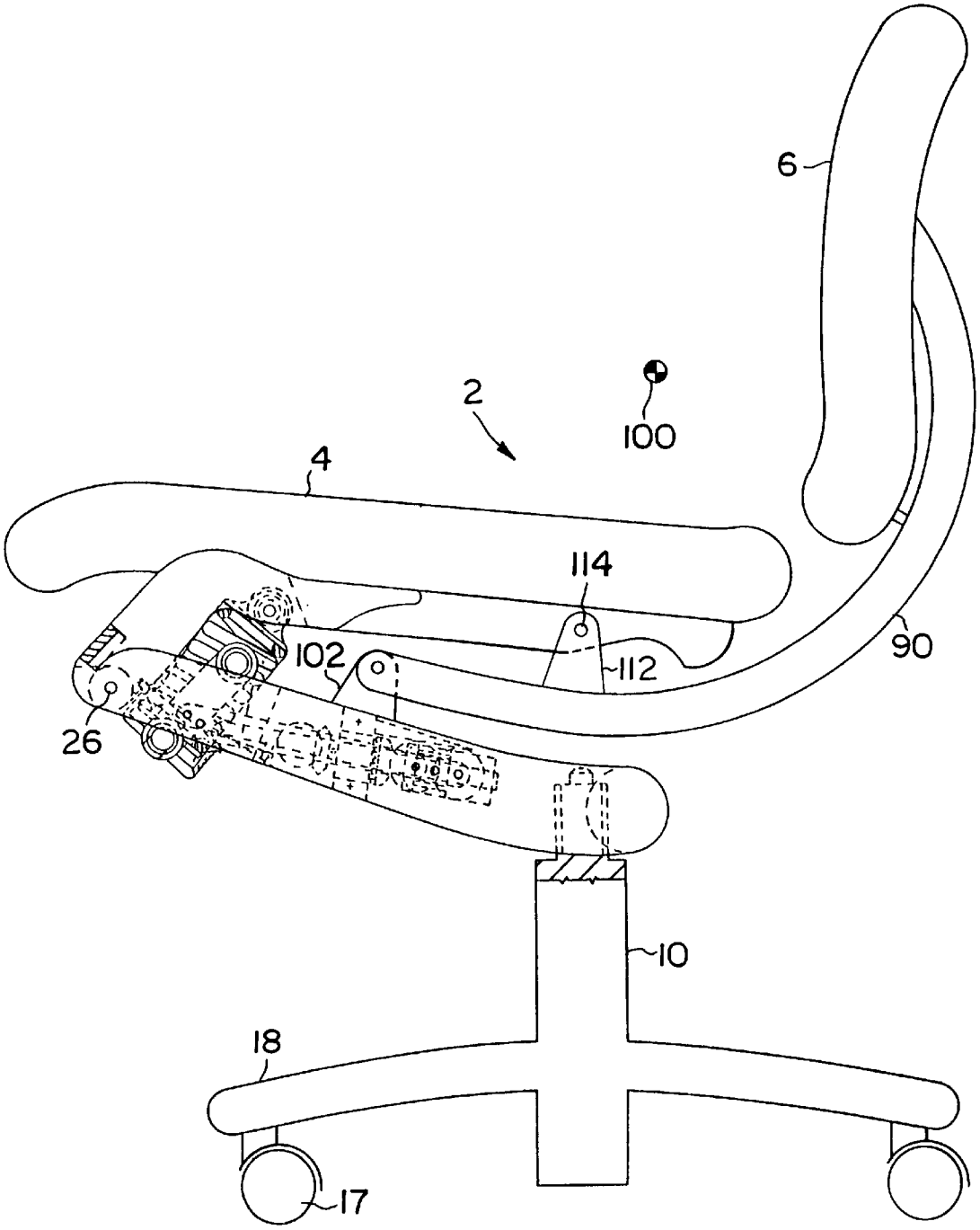

Referring the FIG. 12, shown therein is a fifth embodiment of the present invention. This fifth embodiment is similar to, and performs the same function as, the second third and fourth embodiments previously described. Therefore, those elements of the fifth embodiment which are the same as the elements in the second, third and fourth embodiments are given like reference numerals and function substantially the same way. However, instead of having a link 92 as in the third embodiment, in this fifth embodiment an upwardly extending support plate 112 is provided in the curved link 90. This upwardly extending plate 112 is pivotally connected at 114 to the seat 4.

This mechanism of the fifth embodiment performs substantially the same function as that of the second, third and fourth embodiments and comprises the curved link 90, upwardly extending support plate 112 and support plate 102. This mechanism allows the seat back 6 to recline or pivot about a point 100 in the proximity of the hip of a person seated on the chair 2 as the seat 4 is downwardly pivoted about the shaft 26. Accordingly, the lengths and placement of the supports 102 and 112 and the pivot 114 are selected such that the intermediate curved link 90 rotates about a radius centered about the point 100 in the proximity of the hip of the person seated in the chair.

As a result of the construction of the reclining chair 2 described in the embodiments above of the present invention, not only can a comfortable chair be provided but also one which is comfortable for a wide range of individuals of different weights.

It should be apparent that the present invention would work equally as well if the mechanism was inverted or placed horizontally with additional links. It should also be apparent to those skilled in the art that numerous and other arrangements could be readily devised without departing from the spirit and scope of the present invention.

We claim:

1. A reclining chair comprising:

a support base;

a chair comprising at least a seat portion;

a means for coupling a forward portion of said seat portion to said support base such that said seat portion moves substantially about a pivoting axis located adjacent said forward portion;

at least one coil spring provided adjacent said forward portion of said portion and between said seat portion and said support base:

a means for coupling ends of said coil spring pivotally to said seat portion and said support base, said means for coupling ends of said coil spring pivotally to said seat portion and support base comprise:

a first spring cup engaging one end of said coil spring, said first spring cup further comprising at least one arm extending longitudinally from said first spring cup along said coil spring with an extending end pivotally coupled to said support base; and a second spring cup engaging another end of said coil spring, said second spring cup pivotally coupled to said seat portion; and a means for pivoting one end of said coil spring about another end of said coil spring;

whereby by pivoting said one end of said coil spring about said another end of said coil spring an effective force per unit distance of said coil spring is varied and said reclining chair is made equally comfortable to sit and recline throughout an entire range from heavy to light-weight persons.

2. The reclining chair according to claim 1, wherein said means for pivoting one end of said coil spring about said another end of said coil spring simultaneously varies a preload and said force per unit distance of said coil spring.

3. The reclining chair according to claim 1, wherein said means for pivoting said one end of said coil spring about said another end of said coil spring comprises a means for moving said first spring cup.

4. A reclining chair comprising a support base;

a chair comprising at least a seat portion and a back portion;

a means for coupling a forward portion of said seat portion to said support base such that said seat portion moves substantially about a pivoting axis located adjacent said forward portion;

at least one coil spring provided adjacent said forward portion of said seat portion and between said seat portion and said support base;

a means for coupling ends of said coil spring pivotally to said seat portion and said support base, said means for coupling ends of said coil spring pivotally to said seat portion and support base comprise:

a first spring cup engaging one end of said coil spring, said first spring cup further comprising at least one arm extending longitudinally from said first spring cup along said coil spring with an extending end pivotally coupled to said support base; and a second spring cup engaging another end of said coil spring, said second spring cup pivotally coupled to said seat portion;

a means for pivoting one end of said coil spring about another end of said coil spring;

a means for coupling said seat and back portions together such that when said seat portion is pivoted about said pivoting axis, said back portion simultaneously pivotally moves about a pivoting axis located above said portion and adjacent said back portion;

whereby by pivoting said one end of said coil spring about said another end of said coil spring an effective force per unit distance of said coil spring is varied and said reclining chair is made equally comfortable to sit and recline throughout an entire range from heavy to light-weight persons.

5. The reclining chair according to claim 4, wherein said means for pivoting one end of said coil spring about said another end of said coil spring simultaneously varies a preload and a force per unit distance of said coil spring.

6. The reclining chair according to claim 4, wherein said means for pivoting said one end of said coil spring about said another end of said coil spring comprises a means for moving said first spring cup.

* * * * *